US007350382B2

(12) United States Patent
Hoffmann

(10) Patent No.: US 7,350,382 B2
(45) Date of Patent: Apr. 1, 2008

(54) TURNBUCKLE LOCK

(75) Inventor: Rainer Hoffmann, Langenfeld (DE)

(73) Assignee: EMKA Beschlagteile GmbH & Co. KG (DE)

( * ) Notice: Subject to any disclaimer, the term of this patent is extended or adjusted under 35 U.S.C. 154(b) by 295 days.

(21) Appl. No.: 10/547,167

(22) PCT Filed: Feb. 13, 2004

(86) PCT No.: PCT/EP2004/001394

§ 371 (c)(1),
(2), (4) Date: Aug. 25, 2005

(87) PCT Pub. No.: WO2004/076787

PCT Pub. Date: Sep. 10, 2004

(65) Prior Publication Data

US 2006/0243007 A1 Nov. 2, 2006

(30) Foreign Application Priority Data

Feb. 26, 2003 (DE) ..... 203 03 200 U

(51) Int. Cl.
*E05B 65/06* (2006.01)

(52) U.S. Cl. ..... 70/139; 70/372; 70/373; 70/375; 70/379 R; 292/194; 292/202; 292/DIG. 53; 292/DIG. 64

(58) Field of Classification Search ..... 70/137, 70/139, 344, 346, 347, 372, 373, 375, 370, 70/380, 379 R, 448, 379 A, 449, 451, 490, 70/367, 369, 391, DIG. 61; 292/194, 202, 292/336.5, DIG. 30, DIG. 53, DIG. 64
See application file for complete search history.

(56) References Cited

U.S. PATENT DOCUMENTS 3,303,678 A * 2/1967 Zoltan, et al. ..... 70/373

(Continued)

FOREIGN PATENT DOCUMENTS

DE 33 16 834 11/1984

(Continued)

*Primary Examiner*—Lloyd A. Gall
(74) *Attorney, Agent, or Firm*—Robert W. Becker; Robert W. Becker & Associates

(57) ABSTRACT

A turnbuckle lock for use on a thin-walled door includes a locking tongue and actuating mechanism that are formed as one piece with one another. An inner seal disposed between the housing and actuating mechanism is formed by being sprayed onto the housing. The actuating member and the housing member enclosing the actuating mechanism are permanently connected to each other, and the inner seal is placed inside at least one free space formed on the actuating mechanism. The inner seal and outer seal also may be formed as a one-piece element. By the permanent connection of the housing and the component made up of the actuating mechanism and the locking tongue, it is ensured that the locking tongue cannot be detached from the actuating mechanism, so that the locking function of the turnbuckle lock is always provided.

10 Claims, 3 Drawing Sheets

U.S. PATENT DOCUMENTS

| | | | | | |
|---|---|---|---|---|---|
| 3,465,557 | A | * | 9/1969 | Ryder | 70/139 |
| 4,270,780 | A | * | 6/1981 | Bernard | 292/202 |
| 4,289,001 | A | * | 9/1981 | Corfield | 70/346 |
| 4,380,161 | A | * | 4/1983 | Bassi | 70/168 |
| 4,494,781 | A | * | 1/1985 | Lafosse | 292/60 |
| 4,910,982 | A | | 3/1990 | Dana | |
| 5,237,843 | A | * | 8/1993 | Charbonneau et al. | 70/346 |
| 5,413,392 | A | * | 5/1995 | Schlack et al. | 292/204 |
| 5,634,359 | A | * | 6/1997 | Huebschen | 70/379 R |
| 6,209,369 | B1 | * | 4/2001 | Freck | 70/375 |
| 6,408,662 | B1 | * | 6/2002 | Sugimoto | 70/375 |
| 6,443,505 | B1 | * | 9/2002 | Linares et al. | 292/195 |
| 6,568,226 | B1 | * | 5/2003 | Ramsauer | 70/127 |

FOREIGN PATENT DOCUMENTS

| | | |
|---|---|---|
| DE | 44 40 852 | 6/1996 |
| EP | 0 936 712 | 8/1999 |
| WO | WO 91/14845 | 10/1991 |

* cited by examiner

TURNBUCKLE LOCK

This specification for the instant application should be granted the priority date of Feb. 26, 2003, the filing date of the corresponding German patent application 20303200.4 as well as the priority date of 13 Feb. 2004, the filing date of the corresponding International patent application PCT/EP2004/001394.

BACKGROUND OF THE INVENTION

The invention relates to a turnbuckle lock, especially for use on a thin-walled door particularly of control cabinets, with a housing that penetrates through the door in an associated opening and that can be fixed to the door by means of a housing head supported thereon, an actuating mechanism rotatably disposed in the interior of the housing, as well as a locking tongue connected with the actuating mechanism. The turnbuckle lock includes an outer seal to be placed between the housing head and the door during mounting to the door for radial sealing of the door opening, and an inner seal is disposed in the interior of the housing for sealing the actuating mechanism from the housing.

This type of turnbuckle lock is described in DE-C2-33 16 834. With the known turnbuckle lock, the actuating mechanism is inserted into the housing by the housing head of the housing arranged on the outside of the door and is supported in the interior of the housing via a correspondingly formed shoulder against a further axial displacement in the housing; a locking tongue is connected in a positive-fit manner to a shoulder of the actuating mechanism projecting over the inside of the housing and is fixed to the actuating mechanism by a screw that is screwed axially into the actuating mechanism. In addition, a corrugated disk is disposed between the housing and actuating mechanism for tolerance compensation, among other things. For sealing the turnbuckle lock housing, first an outer seal is necessary, the outer seal being mounted on the underside of the housing head during assembly. The outer seal also assumes the function of radial sealing of the door opening against the turnbuckle lock. An inner seal is disposed in the interior of the housing additionally for sealing the housing against the rotatable actuating mechanism therein.

A disadvantage of the known turnbuckle lock is that the individual components of the turnbuckle lock, such as the housing, the actuating mechanism, the locking tongue, the attachment screw, as well as the inner seal and outer seal, must be manufactured and stored in independent production steps. A further disadvantage is that for manufacturing of an individual turnbuckle lock, separate assembly of the individual parts to one another is necessary.

The invention is therefore based on the object of providing a turnbuckle lock with the above-described features which can be made simply and therefore, with lower costs.

SUMMARY OF THE INVENTION

The invention contemplates in its basic concept that the locking tongue and actuating mechanism are formed as one piece with one another and the inner seal disposed between the housing and actuating mechanism is formed by spraying onto the housing. The actuating member and the housing member enclosing the actuating mechanism are permanently connected to each other, whereby the inner seal is placed inside at least one free space formed on the actuating mechanism. The advantage connected with the present invention is that based on the one-piece design of the actuating mechanism and the locking tongue, in addition to the component made in this manner, only the housing still must be made. In particular, the inner seal is sprayed onto the housing in the so-called two-K method, and therewith, is an integral component of the turnbuckle lock. By the permanent connection of the housing and the component comprised of the actuating mechanism and the locking tongue, according to the present invention, it is ensured in an advantageous manner that the locking tongue cannot be detached from the actuating mechanism, so that in cooperating with the housing, the locking function of the turnbuckle lock is always provided.

According to one embodiment of the invention, the inner seal that serves for sealing the housing from the actuating mechanism is formed as one-piece with the outer seal disposed on the underside of the housing head that serves for sealing the housing from the door. For connection of the outer seal and the inner seal to the housing, channels for receiving sprayed-on connection strands extending in the longitudinal direction of the housing are formed. These features provide the advantage that in addition to the manufacture of the inner seal, also the outer seal is integrated into the turnbuckle lock, so that a high degree of protection during use of the turnbuckle lock of the present invention is achieved.

According to an expedient embodiment of the invention, the permanent connection of the housing and the actuating mechanism is made during a simultaneous manufacture of the housing by extrusion-coating of the actuating mechanism. In this manner, the particular advantage of saving a further manufacturing or assembly step is provided.

According to one embodiment of the invention, the actuating mechanism and housing are connected to each other in a positive-fit manner and the actuating mechanism has a radial constriction in the section enclosed by the housing, and the housing has a shoulder that engages in the constriction. For formation of the free space, the longitudinal extension of the constriction of the actuating mechanism is dimensioned to be larger than the longitudinal extension of the shoulder of the housing, whereby the inner seal between the actuating mechanism and the housing can be injected into the free space defined by the edge of the constriction facing the housing head and the shoulder.

Alternatively, the permanent connection of the housing and actuating mechanism also can be made by adhesion, rivets, and clips or welding of the two components to be connected.

According to one embodiment of the invention, the head oriented for access by a tool comprises a zinc die cast material; with this feature, the durability of the actuating mechanism during use of an opening tool is increased, whereby the further base body of the actuating mechanism is formed commonly with the locking tongue as one piece and is sprayed onto the zinc die-cast head of the actuating mechanism.

For formation of a quick attachment, according to one embodiment of the invention, the housing is provided with an outer threading distributed in two thread sections on its outer side adjacent to the housing head. The oppositely disposed outer thread sections are separated from one another by two planar surfaces. The connecting nut formed with a corresponding shape can be placed onto the housing with its planar sections until contacting the back side of the door, and thereafter, is rotatable at an angle, whereby the inner thread section formed on the planar surfaces of the connecting nut engage with the outer thread sections of the housing.

According to another embodiment of the invention, for the permanent connection of the housing and actuating mechanism by clipping, two axially projecting clip arms with clip projections engaging in a back groove formed on the actuating mechanism are provided on the front face of the housing opposite the housing head. The clip arms can be held in engagement with the actuating mechanism by the screwed-on connecting nut.

Finally, according to one embodiment of the present invention, the threads on the threading formed on the connecting nut and/or the housing are provided with radially projecting locking teeth that engage in the opposite threads. With these features, temperature fluctuations, lacquers, lacquer unevenness on the door panel, or dynamic effects of vibration of the environment can be neutralized, so that an independent loosening of the connecting nut from the housing can be excluded.

BRIEF DESCRIPTION OF THE DRAWINGS

In the drawings, embodiments of the invention are illustrated, which will be described next. In the drawings.

DESCRIPTION OF SPECIFIC EMBODIMENTS

Figure 1:
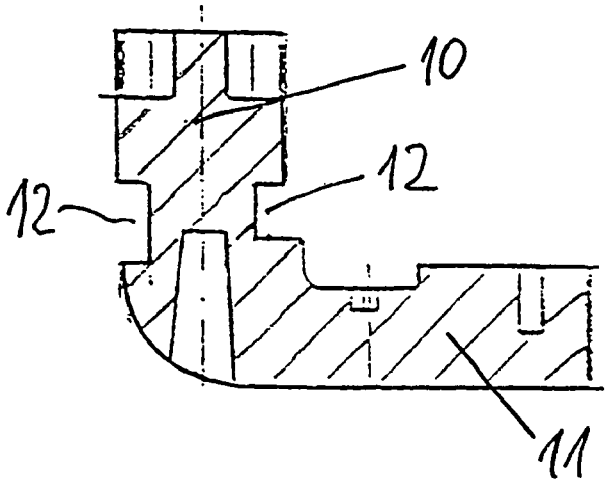
FIG. 1 shows the component comprising the actuating mechanism and locking tongue in a sectional side view.

As shown in FIG. 1, the actuating mechanism 10 and locking tongue 11 are formed as a one-piece component, whereby this component can be made from any material. Therefore, it can be expedient if the head 30 (FIG. 6) of the actuating mechanism 10 comprises a zinc die cast material, while the remaining body of the actuating mechanism 10 including the locking tongue 11 comprises plastic and is sprayed onto the head 30 of the actuating mechanism. The actuating mechanism 10 is provided with a circumferential constriction 12, which above the connected locking tongue 11 has a smaller axial longitudinal extension than on the remaining circumference of the actuating mechanism 10.

Figure 2:
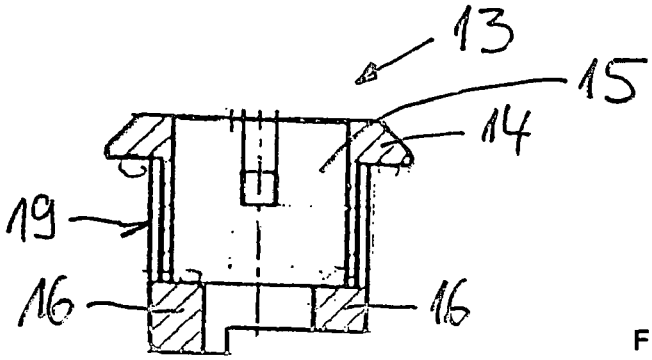
FIG. 2 shows the housing of the turnbuckle lock in a first embodiment in a sectional side view.

The housing 13 shown in FIG. 2 has a flange-like housing head 14 on its upper end, with which the housing 13 comes into contact with the door panel upon mounting to a door. The housing 13 has an inner bore 15 for receiving the actuating mechanism, and on the lower end of the housing 13, the housing 13 has a circumferential shoulder 16, which cooperates with the constriction 12 of the actuating mechanism 10 (FIG. 1) and has a corresponding axial extension with regard to conforming with the shape of the constriction 12.

Figure 3:
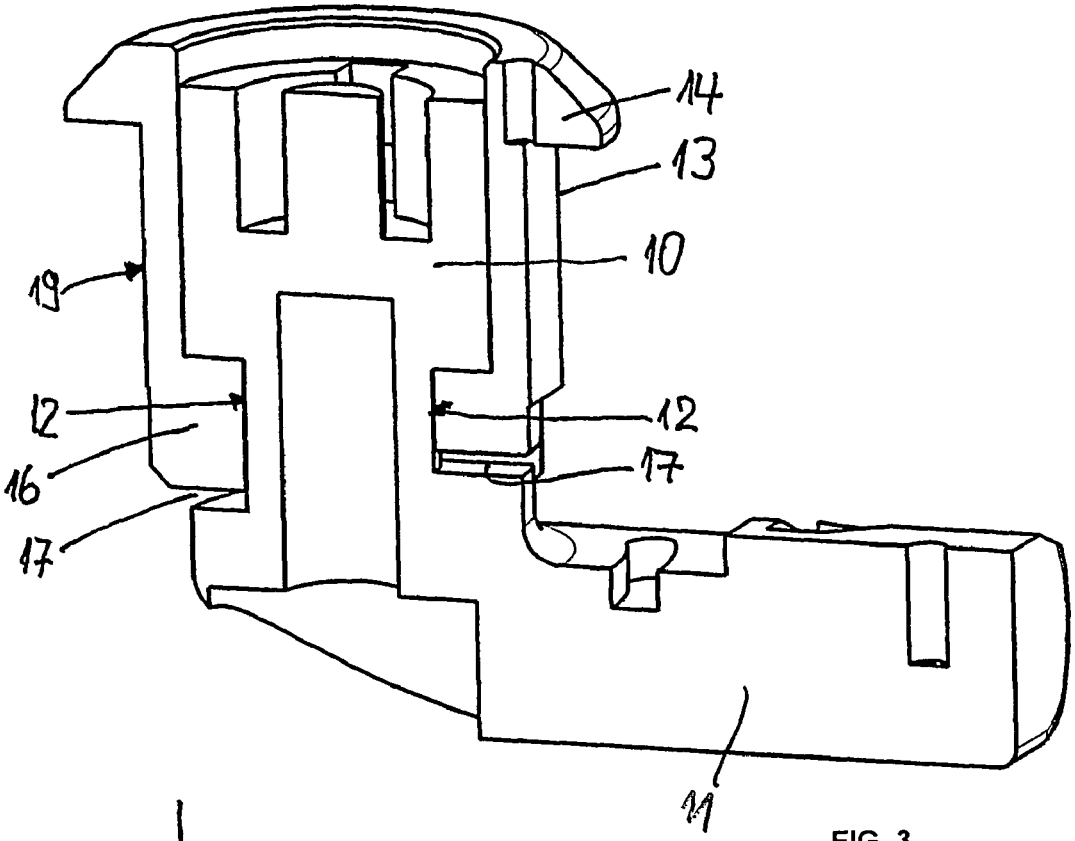
FIG. 3 shows the turnbuckle lock with combined individual parts according to FIGS. 1 and 2 in a sectional side view before spraying on of the seal.
Figure 4:
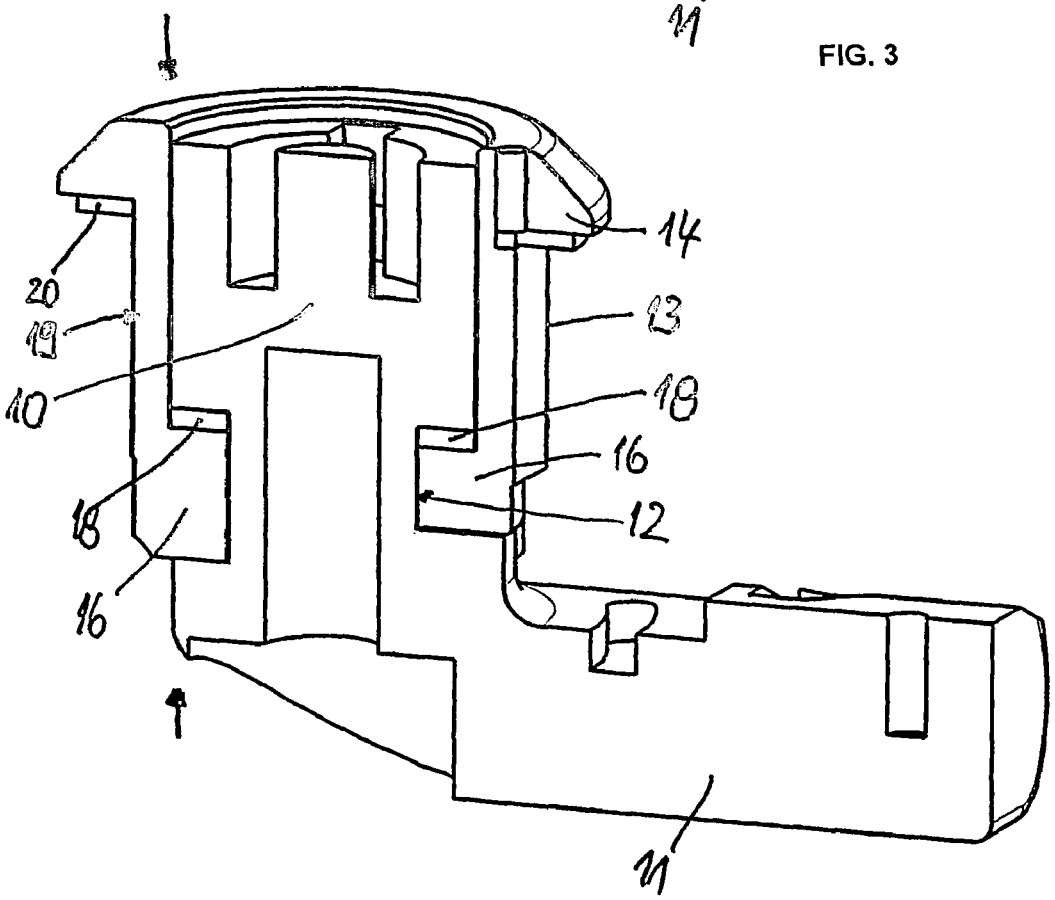
FIG. 4 shows the subject matter of FIG. 3 after spraying on of the seal.

The permanent connection shown in FIGS. 3 and 4 of the component shown in FIG. 1 with the housing 13 shown in FIG. 2 is based on a manufacturing method in which the manufacture of the housing 13 enclosing the actuating mechanism 10 takes place by extrusion coating of the actuating mechanism 10 with a suitable, sprayable material, preferably a suitable plastic. With this spraying method shown in FIG. 3, the axial longitudinal extension of the shoulder 16 is proportional to the size of the constriction 12 of the actuating mechanism 10, such that a free space 17 remains between the lower end of the shoulder 16 and the adjacent limiting edge of the constriction 12. As shown in FIG. 4, the housing 13 and the actuating mechanism 10 are pressed against one another, so that the housing 13 is axially displaced relative to the actuating mechanism 10 and the free space 17 comes to rest on the upper end of the constriction facing the housing head 14. In this position, the free space positioned in this manner is sprayed with a sealing mass, so that the inner seal 18 is provided in this area. Since on the outer circumference of the housing 13, channels 19 are formed which extend from the inner seal 18 to the underside of the housing head 14, the sealing material injected into the free space 17 flows via the channels 19 into the area of the housing head 14 and forms here the outer seal 20 with a corresponding shape of the associated mold.

Figure 5:
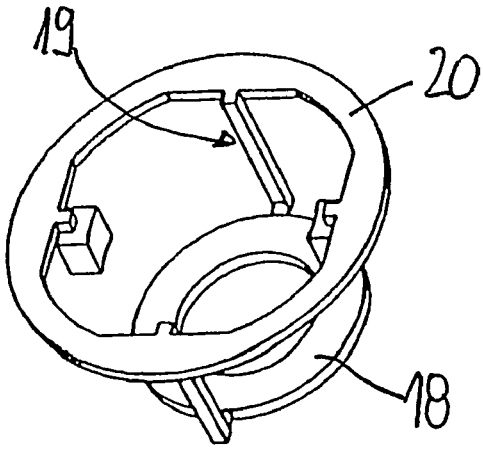
FIG. 5 shows a sealing body comprised of the inner seal and the outer seal in an isolated diagram representation.

In FIG. 5, the configuration of the inner seal 18 and the outer seal 20 made in one processing step can be seen.

Within the scope of such a manufacturing process, it is advisable to provide the sealing material with a different shape than the housing and/or actuating mechanism, because in this manner, it can be checked by visual inspection that particularly the outer seal 20 is realized in a sufficient shape.

Figure 6:
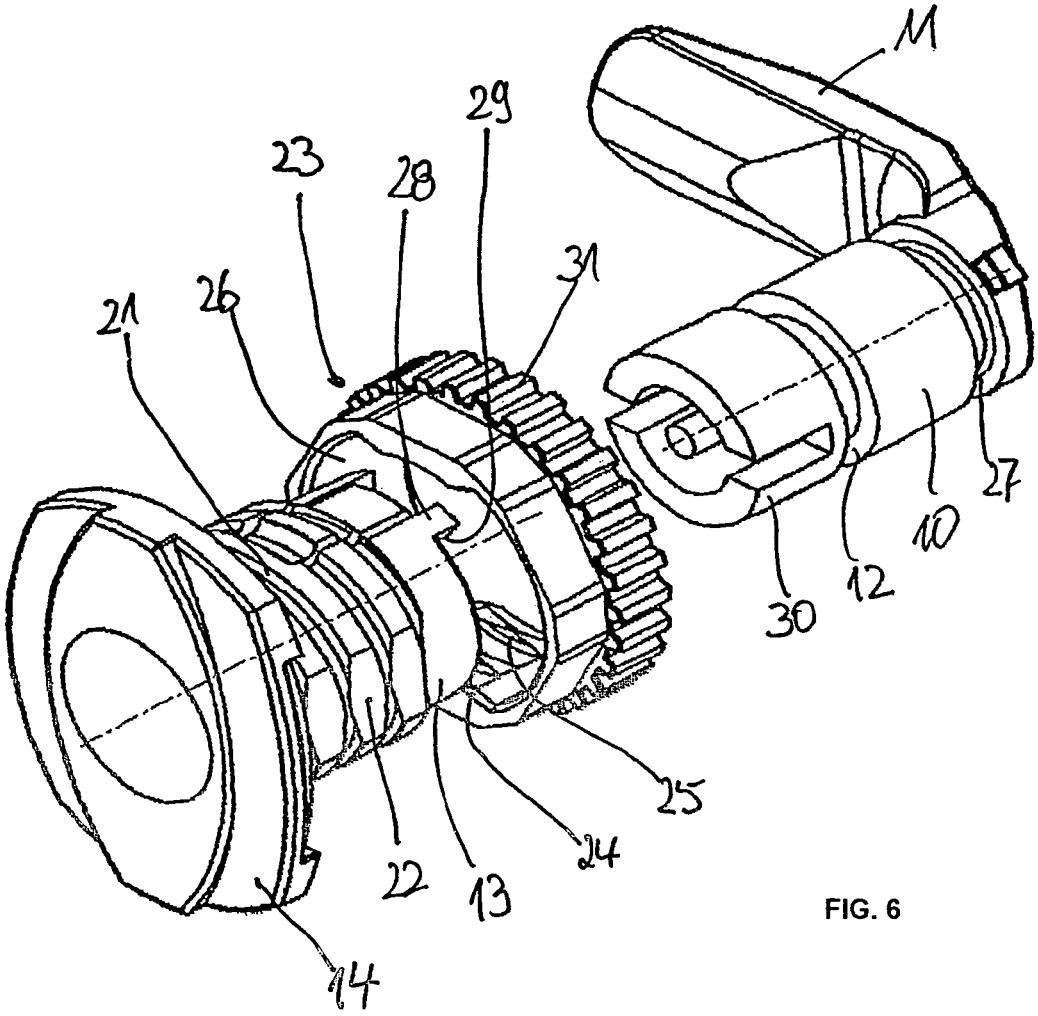
FIG. 6 shows another embodiment of a turnbuckle lock comprised of a housing, actuating mechanism with locking tongue, and connecting nut in an exploded representation.
Figure 7:
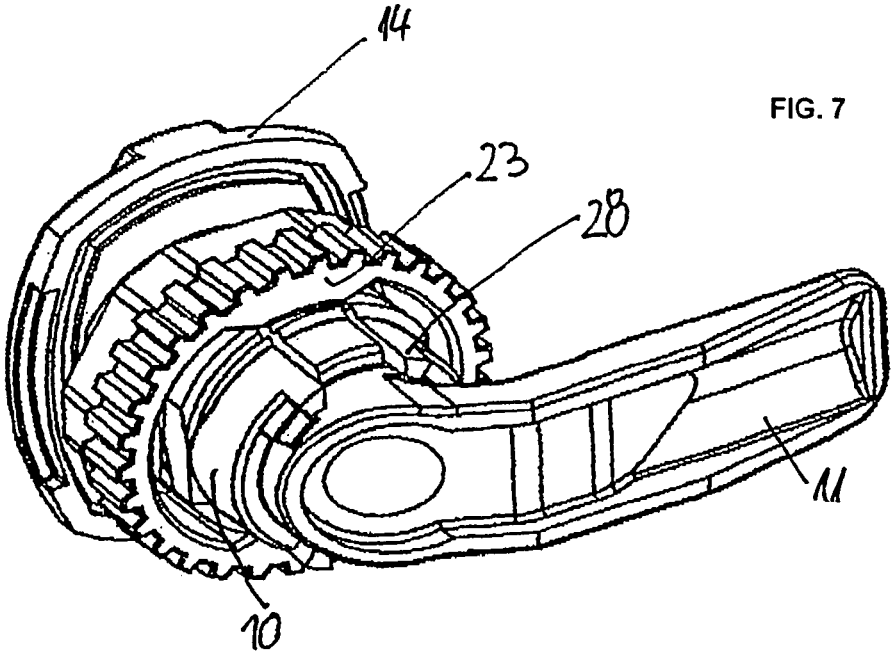
FIG. 7 shows the subject matter of FIG. 6 in an assembled state.

In FIGS. 6 and 7, another embodiment of the turnbuckle lock is shown, which includes a quick attachment of the turnbuckle lock to a door panel (not shown) and further—in contrast to the embodiment described with reference to FIGS. 1 through 5—is based on a clip connection between the actuating mechanism with a locking tongue and housing.

As can be seen first from FIG. 6, an outer threading is provided on the outside of the housing 13, which is subdivided into two oppositely arranged outer threading sections 21, whereby these outer threading sections 21 are separated from one another by two planar surfaces 22, respectively. The connecting nut 23 placeable onto the housing 13 and serving for attachment has an inner threading in a corresponding shape, which, likewise, has two inner threading sections 25, which are formed to the planar surfaces 24 provided on the connecting nut 23; the planar surfaces 24 with the inner threading sections 25 formed thereon are connected to one another by circular arc sections 26. The respective planar surfaces serve for axial displacement of the connecting nut 23 up to the point of contact with the back surface of the door panel (not shown). By means of a partial rotation of the connecting nut 23 relative to the housing 13, the turnbuckle lock is secured to the housing based on a correspondingly directed threading pitch.

With regard to the permanent connection of the housing 13 and actuating mechanism 10 via a clip connection, two axially projecting clip arms 28 with radially inwardly projecting clip projections 29 are arranged on the front face of the housing 13 opposite to the housing head 14. The clip projections 29 engage in a rear groove 27 formed on the actuating mechanism 10 that is adjacent to the locking tongue 11. For better mounting, the clip projections 29 can be formed with a corresponding chamfer. In the mounted state (FIG. 7), the clip arms 29 are held in engagement with the actuating mechanism 10 by means of the unscrewed connecting nut 23.

On the outside of the connecting nut 23, an outer toothing 31 is provided in the embodiment shown, on which a suitable tool can be applied for mounting the connecting nut 23.

The features of the subject matter of this disclosure provided in the foregoing description, in the patent claims, and shown in the drawings can be important individually as well as in any combination with one another for the realization of the invention in its various embodiments.

The specification incorporates by reference the disclosure of German priority document 203 03 200.4 filed Feb. 26, 2003 and PCT/EP2004/001 394 filed 13 Feb. 2004.

The present invention is, of course, in no way restricted to the specific disclosure of the specification and drawings, but also encompasses any modifications within the scope of the appended claims.

The invention claimed is:

1. A turnbuckle lock for use on a thin-walled door, comprising:

a housing, wherein said housing penetrates through the door in an associated opening, wherein the housing is fixed to the door by means of a housing head supported thereon;

an actuating mechanism rotatably disposed in an interior of the housing;

a locking tongue connected with the actuating mechanism;

an outer seal positioned between the housing head and the door during mounting to the door for radial sealing of the door opening;

an inner seal disposed in the interior of the housing for sealing the actuating mechanism from the housing, wherein the locking tongue and actuating mechanism are formed as one piece with one another, wherein the inner seal disposed between the housing and actuating mechanism is formed by spraying onto the housing, wherein the actuating mechanism and the housing enclosing the actuating mechanism are permanently connected to each other, and wherein the inner seal is placed inside at least one free space embodied on the actuating mechanism.

2. The turnbuckle lock of claim 1, wherein the inner seal that serves for sealing the housing from the actuating mechanism is formed as one-piece with the outer seal disposed on an underside of the housing head, wherein for connection of the outer seal and the inner seal to the housing, channels for receiving sprayed-on connection strands extending in the longitudinal direction of the housing are formed on the housing.

3. The turnbuckle lock of claim 1, wherein the actuating mechanism and the housing are connected to each other in a positive-fit manner, wherein the actuating mechanism has a radial constriction in a section enclosed by the housing, wherein the housing has a shoulder that engages in the constriction, and wherein for formation of the free space, a longitudinal extension of the constriction is dimensioned to be larger than a longitudinal extension of the shoulder.

4. The turnbuckle lock of claim 1, wherein the permanent connection of the housing and actuating mechanism is made by simultaneous manufacture of the housing by extrusion coating of the actuating mechanism.

5. The turnbuckle lock of claim 3, wherein the inner seal between the actuating mechanism and housing is injected into the free space (17) defined by an edge of the constriction facing toward the housing head and the shoulder.

6. The turnbuckle lock of claim 1, wherein the actuating mechanism has a head, wherein the head of the actuating mechanism is oriented for access by a tool and comprises a zinc die cast material.

7. The turnbuckle lock of claim 1, wherein the housing is provided with an outer threading subdivided in two oppositely disposed thread sections on an outer side adjacent to the housing head, the thread sections being separated from one another by two planar surfaces, wherein a connecting nut is provided, wherein said connecting nut is formed with a corresponding shape for placement onto the housing with its planar sections until contacting a back side of the door, and thereafter, is rotatable at an angle, whereby an inner thread section formed on the planar surfaces of the connecting nut engage with the outer thread sections of the housing.

8. The turnbuckle lock of claim 1, wherein two axially projecting clip arms are provided on the front face of the housing opposite the housing head, and wherein said clip arms have clip projections that engage in a back groove formed on the actuating mechanism.

9. The turnbuckle lock of claim 8, wherein the clip arms are held in engagement with the actuating mechanism by means of the screwed-on connecting nut.

10. The turnbuckle lock of claim 7, wherein threads between the nut and housing are provided with radially projecting locking teeth that engage in opposite threads.

* * * * *